US006068163A

United States Patent [19]

Kihm

[11] Patent Number: 6,068,163

[45] Date of Patent: May 30, 2000

[54] FUEL DISPENSING APPARATUS

[76] Inventor: Scott C. Kihm, 214 Hilltown Pike, Line Lexington, Pa. 18932

[21] Appl. No.: 08/819,680

[22] Filed: Mar. 17, 1997

[51] Int. Cl.[7] ..... B67D 5/58

[52] U.S. Cl. ..... 222/189.1; 222/397; 222/402; 222/464.7; 222/505; 222/530; 251/321

[58] Field of Search ..... 222/401, 402, 222/397, 382, 464.1, 464.7, 377, 530, 538, 561, 505, 189.1; 141/392; 251/321

[56] References Cited

U.S. PATENT DOCUMENTS

| | | | |
|---|---|---|---|
| 817,391 | 4/1906 | Robertshaw | 222/401 |
| 912,603 | 2/1909 | Nestor | 222/401 |
| 1,363,656 | 12/1920 | Jonassen | 222/401 |
| 1,691,097 | 11/1928 | Waters, Jr. | 222/402 |
| 2,625,302 | 1/1953 | Mahoney | 222/561 X |
| 2,645,381 | 7/1953 | Lattman | 222/401 |
| 2,723,056 | 11/1955 | Smith | 222/396 |
| 3,731,855 | 5/1973 | Vos | 222/561 X |
| 4,919,311 | 4/1990 | Born | 222/401 |
| 4,972,972 | 11/1990 | Goguen | 222/130 |
| 4,984,742 | 1/1991 | Ellison et al. | 222/401 X |
| 5,088,632 | 2/1992 | Odet et al. | 222/530 X |
| 5,289,945 | 3/1994 | Stradder | 222/561 X |
| 5,400,928 | 3/1995 | Resnick | 222/530 |
| 5,469,993 | 11/1995 | Hauf et al. | 222/530 X |
| 5,630,532 | 5/1997 | Herkenne et al. | 222/397 X |
| 5,669,532 | 9/1997 | Dorow et al. | 222/402 X |
| 5,826,758 | 10/1998 | McArthur et al. | 251/321 X |

OTHER PUBLICATIONS

"Pumper" (brochure), DRI Industries, (Received in USPTO on Oct. 3, 1985.

*Primary Examiner*—Kevin Shaver
*Attorney, Agent, or Firm*—Joseph W Molasky & Associates

[57] ABSTRACT

A portable dispensing apparatus in which a fuel containing chamber is pressurized by a hand operated air pump. The fuel is dispensed by a pickup tube whose receiving end is within the chamber where it is joined to a flexible hose equipped with a bellows; the opposite end being connected to a valved handle outside the chamber and includes a nozzle for dispensing the fuel. An actuation lever pivotally mounted to the handle allows the operator to control the flow rate and velocity of emitted fuel so that even incremental amounts can be dispensed without difficulty. The flexible hose can be stored in a skirt on the handle.

8 Claims, 3 Drawing Sheets

FIG. 3
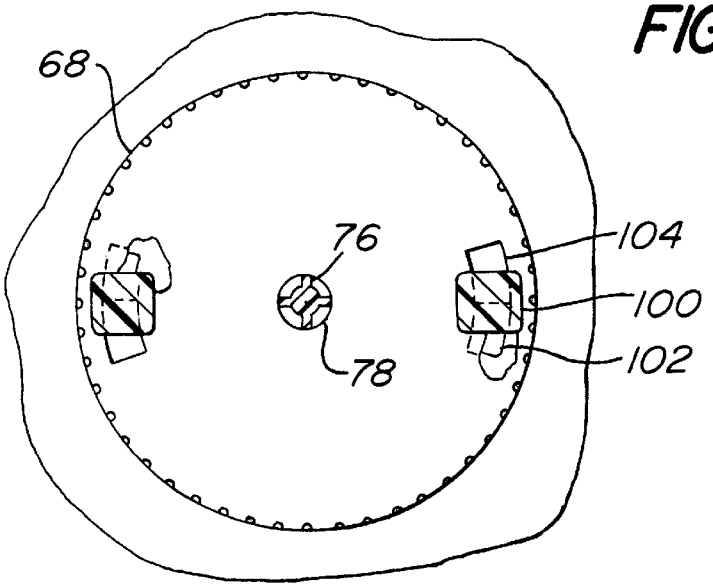
FIG. 4
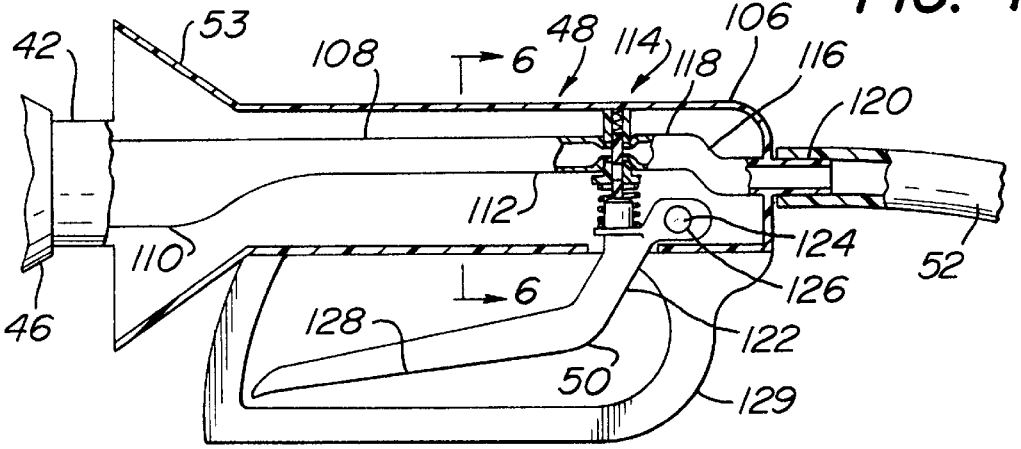
FIG. 6
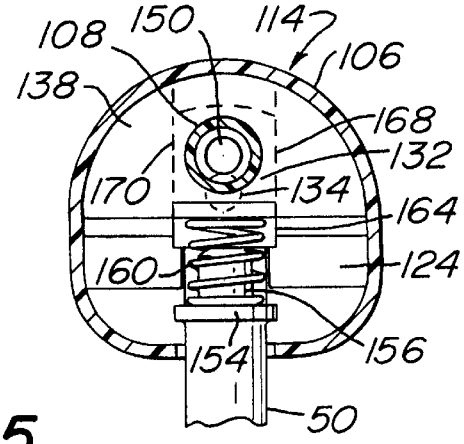
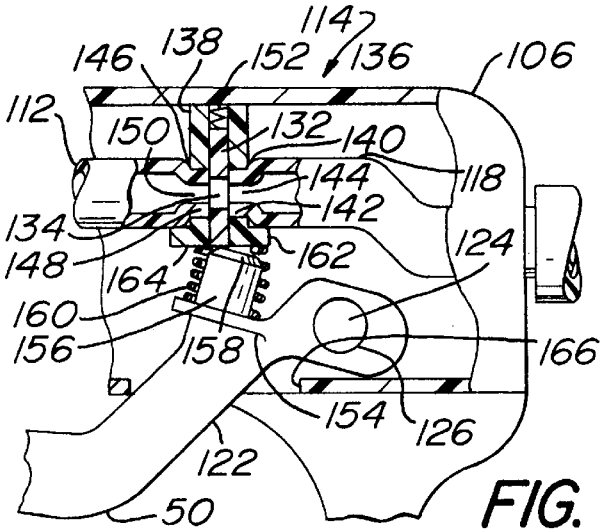
FIG. 5

FUEL DISPENSING APPARATUS

BACKGROUND OF THE INVENTION

1. Field of the Invention

This invention relates to fuel containers of the type used to transport and dispense fuel. More particularly, this invention is a new and improved portable fuel dispensing container for conveniently and controllably dispensing fuel.

2. Description of the Prior Art

The use of portable fuel containers for servicing lawn mowers or other appliances is well known in the art. They provide a convenient means for replenishing expended fuels in appliances that require periodic refueling; sometimes at remote locations where fuel is not available.

One difficulty with containers of this type is that they usually operate on the gravity-flow principle, that is, the container and its contents must be raised to a level which is higher, sometimes substantially higher, than the appliance which is being served.

Attempts have been made to address this problem by pressurizing the container so as to impel the fuel through a transmitting hose so that gravity is not a factor and no lifting is required.

This is an improvement on gravity-flow, but it does not address the myriad other difficulties associated with pressurized containers that rely on hose means for fuel delivery.

U.S. Pat. No. 4,972,972 issued to GOGUEN discloses a portable fuel dispensing container including a hand-operated pressurizing pump whereby an elongated tubular hose is used to deliver pressurized fuel to a lever actuated discharge nozzle and into the receiving tank. The container has a hose storage chamber into which the hose can be coiled and stored during periods of nonuse. However, the hose is not extendible and retractable during usage and the nozzle is more of an on-off type rather than of a type to allow fine flow rate adjustment.

U.S. Pat. No. 2,723,056 issued to SMITH discloses a container having a hand-operated pressurizing pump whereby an elongated tubular hose is used to deliver fuel to the receiving tank. The hose is stored within the container itself through a seal to maintain pressure during use. Fuel flow is regulated by bleeding pressure in the container using a push button flow control valve and by pinching the tube between the user's fingers. However, while the hose will extend by pulling on it during use, hose retraction is not automatic, necessitating the user to manually push the hose back into the container, which releases the pressure in the tank. Also, there is no positive control of fuel flow since there is no valve means in conjunction with the hose.

U.S. Pat. No. 2,645,381 issued to LATTMAN discloses a portable dispensing tank having a manually operated pump to pressurize a container to dispense fuel via a discharge hose terminating in a non-valved nozzle. Fuel flow is controlled by a cock valve located on the container top. However, the hose does not extend and retract automatically. Further, the valve to regulate fuel flow is not at the dispensing end of the hose so as to be readily accessible and is of a type which does not give fine incremental adjustment of flow rate.

SUMMARY OF THE INVENTION

The portable fuel dispensing container of the invention is designed to obviate the problems associated with present-day prior art devices. Accordingly, the invention has a container for storing and transporting fuel. A pressurizing pump, which may include a one-piece piston and rod, a rotatably locking pump handle, and an over pressure relief valve, extends into the container to pressurize the fuel and air within the container. A pickup tube, which may incorporate a filter to prevent contaminates in the fuel from leaving the container chamber, extends from a lower recessed area of the container comprising a fuel well to an extendible and retractable intermediate tube including bellows and which directs the pressurized fuel to an elongated handle. Inside the handle is a fuel valve having a fuel delivery means and a plate with an orifice splitting the delivery means into two chambers having orifices, the orifice on the plate being selectively positioned between the other orifices to regulate fuel flow through an elongated actuation lever. The actuation lever and valve allow fine incremental flow adjustment to regulate the velocity and amount of fuel being dispensed. After passing through the handle and valve, the fuel is directed through a flexible nozzle into the receiving tank. The handle has a skirt in which the intermediate tube including bellows can be stored and the handle locked to the container cap.

BRIEF DESCRIPTION OF THE DRAWINGS

FIG. 3 is a partially broken sectional view taken on line 3—3 of FIG. 2.

FIG. 4 is a longitudinal sectional view of the handle shown in FIG. 1.

FIG. 5 is a partially broken view of the valve shown in FIG. 4.

FIG. 6 is a sectional view of the hand pump taken on line 6—6 of FIG. 4.

DETAILED DESCRIPTION OF THE PREFERRED EMBODIMENTS

Figure 1:
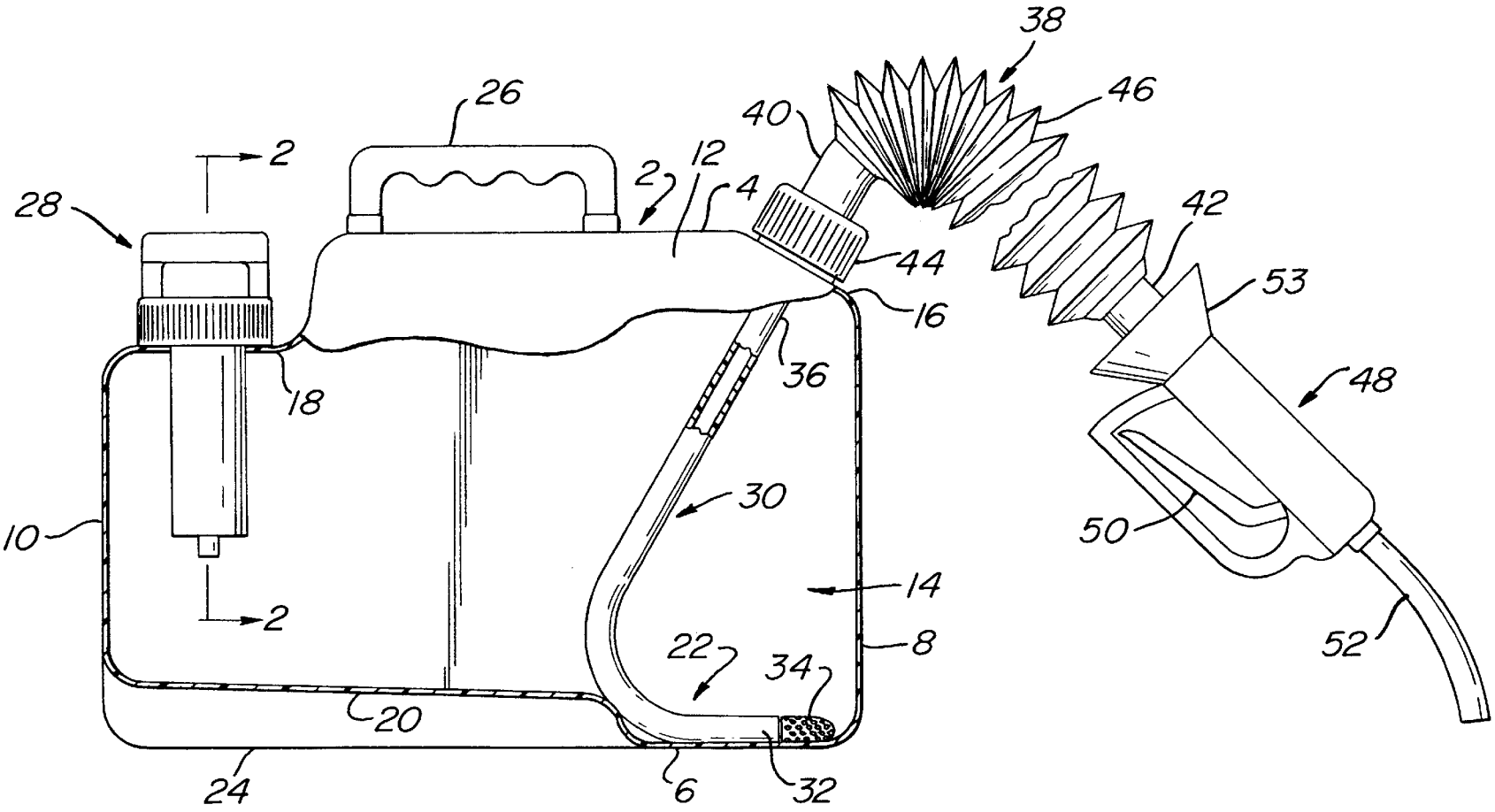
FIG. 1 is a partially broken side elevational view of the dispensing container of this invention.

The portable fuel dispensing apparatus of this invention (FIG. 1) includes a container 2 comprised of a top wall 4, a bottom wall 6, a front wall 8, a rear wall 10, and two side walls 12 which, in combination, define an enclosed chamber 14 for containing and storing fuel. The top wall 4 comprises an angled portion 16 and a step portion 18. The bottom wall 6 comprises a raised portion 20 which is disposed between parallel side walls 12, the raised portion 20 extending about two-thirds of the way from rear wall 10 to front wall 8 and sloping downwardly from the rear wall 10 to the front wall 8. The raised portion 20 defines a fuel well 22 and two parallel legs 24. The purpose of fuel well 22 is to pool whatever fuel remains in chamber 14 when in a low fuel condition such that fuel can still be dispensed without refilling the container 2. The container 2 may rest on any flat surface with the fuel well 22 and legs 24 providing support for the container 2. The container 2 is preferably fabricated from a plastic which is impervious to the corrosive effects of fuels, such as are known in the art, and it is preferably unitary so as to minimize container cost and weight so that more fuel can be carried. Typical of such plastics are synthetic resins such as, for example, a polyalkylene, such as polyethylene or polypropylene and/or polyvinylchloride, and the like.

A carrying handle 26 is mounted to top wall 4 midway between angled portion 16 and step portion 18 to provide a convenient and balanced way for a user to carry the container. A hand operated air pump 28 is removably attached to the step portion 18 and is in contact with the chamber 14 to enable pressurization of fuel and air within the chamber 14. Air pump 28 can be removed to fill the chamber 14 with fuel, and then reattached to seal container 2. Fuel is let out of the container 2 by means of a curved pickup tube 30 disposed within chamber 14, with a first end 32 disposed in the fuel well 22 and extending juxtaposed the bottom wall 6. A fuel screen 34 is attached to first end 32 to prevent contaminates from entering pickup tube 30. A second end 36 of pickup tube 30 extends out of chamber 14 perpendicular to angled portion 16. Fuel passes out of pickup tube 30 into a flexible hose 38 which has an input end 40 and an output end 42. Input end 40 and the second end 36 of pickup tube 30 are both removably and sealingly attached together and to angled portion 16 by conventional means such as by cap 44. Disposed between input end 40 and output end 42 are a plurality of bellows 46 which can extend and retract as needed during the fueling process so as not to interfere with fueling, as opposed to a fixed length hose. Output end 42 is connected to handle assembly 48 which the user holds in hand to dispense fuel by moving an elongated actuation lever 50 which is spring loaded and which actuates a valve means (not shown in FIG. 1) to allow a user fine incremental control of fuel flow. A flexible nozzle 52 is attached to the handle assembly 48 and is of a size to interact with a container being filled. Handle assembly 48 includes a skirt 53 which extends towards flexible hose 38 and in which bellows 46 can be stored. The skirt 53 can be removably attached to container cap 44 for storage as by tabs on skirt 53 or gripping cap 44.

Figure 2:
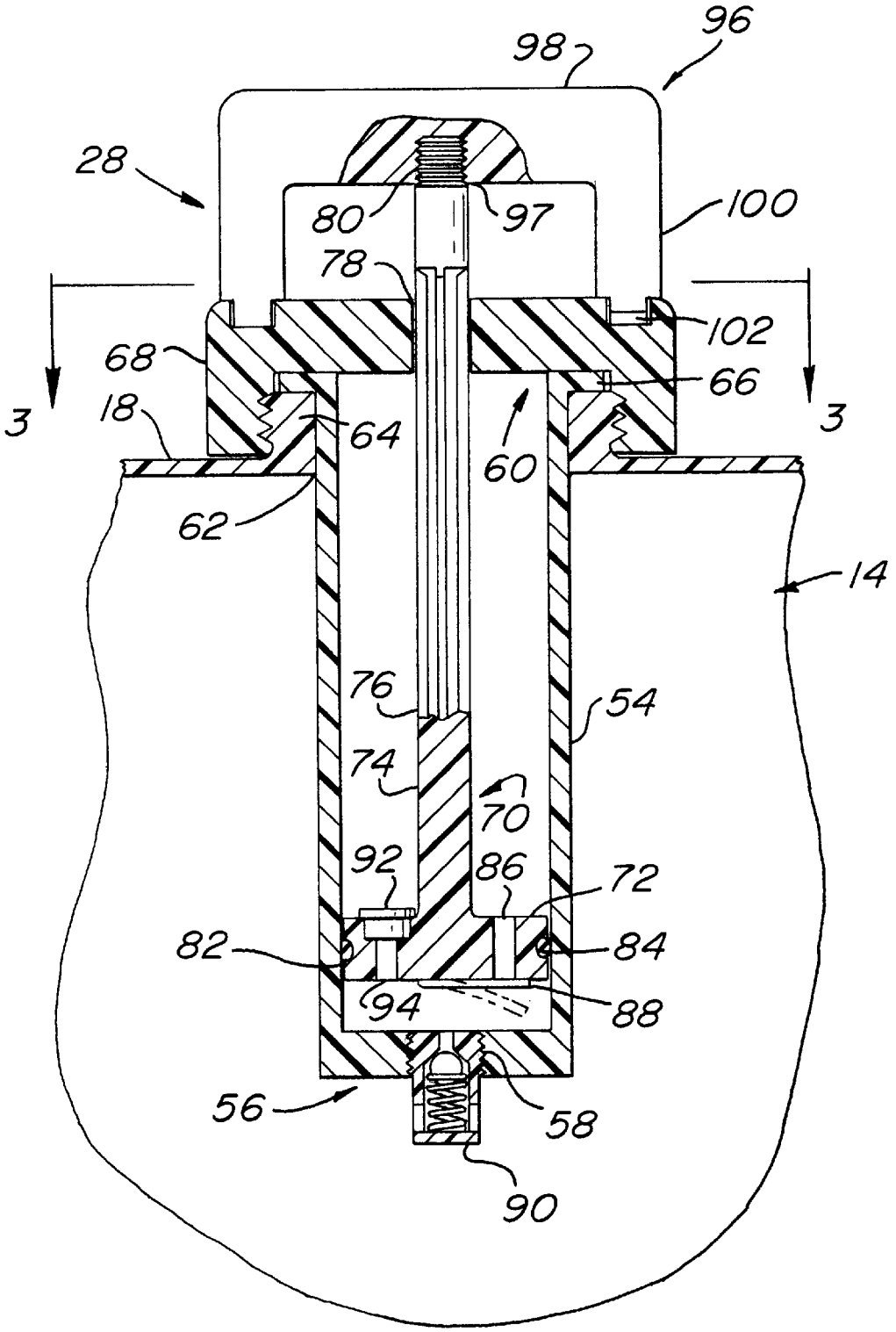
FIG. 2 is a sectional view of the hand pump taken on line 2—2 of FIG. 1.

As best seen in FIG. 2, the hand operated air pump 28 comprises a cylinder 54 disposed within chamber 14, the cylinder comprises a closed end 56 having a threaded aperture 58. The open end 60 of cylinder 54 extends out of container 2 through a circular aperture 62 in step portion 18. An externally threaded well 64 is coaxially disposed about aperture 62 and extends away from chamber 14. Open end 60 has a flange 66 which rests on well 64. An internally threaded pump cap 68 engages well 64 to clamp flange 66 against well 64 thus holding cylinder 54 in place. An integral piston and rod 70 comprising a piston 72 and a rod 74 having flutes 76 is coaxially disposed within the cylinder 54 with piston 72 adjacent the closed end 56 of cylinder 54. Rod 74 extends through a circular rod aperture 78 and terminates with an externally threaded end 80. Flutes 76 extend through aperture 78 thus allowing air to flow through aperture 76 during pump operation. The piston 72 has a circumferential groove 82 into which is disposed a flexible O-ring 84 which seals air from passing by between the piston 72 and the cylinder 54 during pump operation. Piston 72 has a first aperture 86 which extends longitudinally completely through piston 72. A elongated flexible thin flap 88 is affixed to one end to piston 72 and the other end disposed over aperture 84 and acts as a one-way-flapper valve to selectively allow air to flow through first aperture 84 from the closed end 56 of the cylinder 54 (dotted line position) but not the reverse (solid line position). A standard externally threaded ball-type one-way valve 90 is threaded into aperture 58 and allows air to flow from the closed end 56 of cylinder 54 into chamber 14. An overpressure release valve 92 is disposed in a second aperture 94 which longitudinally extends through piston 72. In the event that the pressure in chamber 14 exceeds a predetermined limit, for example, 5 pounds per square inch, relief valve 92 will open as the piston 72 compresses the air in the closed end 56 of cylinder 54 to vent the air through aperture 94 and relief valve 92 back into the open end 60 of cylinder 54, thus bypassing chamber 14. A flat C-shaped pump handle 96 having a threaded aperture 97 for threadedly engaging end 80 is disposed adjacent pump cap 68 and comprises a horizontal grasping bar 98 and a pair of downwardly projecting legs 100, one at each end of grasping bar 98. A locking tab 102 extends beneath each leg 100 and acts in conjunction with a pair of arcuate slots 104 in the pump cap 68 so as to allow selective locking and unlocking of the handle 96 in a retracted position.

Referring to FIG. 3, the pump cap 68 has a pair of arcuate slots 104 located on opposite sides of rod aperture 78, for engaging locking tabs 102 which extend in opposite directions to selectively lockingly engage arcuate slots 104 in a conventional manner. Upon twisting of handle 96 (not shown) in a clockwise direction locking tabs 102 engage arcuate slots 104 to lock handle 96. Twisting in a counterclockwise direction releases locking tabs 102 from arcuate slots 104 to allow pumping to occur. The purpose of this feature is to provide means to maintain the handle 96 in a retracted position during non-use of pump 28 (not shown). As also can be seen, flutes 76 of rod 74 extend through rod aperture 78 to allow air to enter cylinder 54.

Pump 28 is operated by twisting handle 96 counterclockwise to release handle 96, then reciprocating handle 96 along with piston and rod 70. Pulling handle 96 upwards causes air in the open end 60 of cylinder 54 to move through first aperture 86 and past the deflected flexible flap 88 (dotted lines) into the closed end 56 of cylinder 54 which has a lower pressure due to piston 72 moving upwards. During the upstroke, one way valve 90 prevents pressurized air in chamber 14 from moving into cylinder 54. During the downstroke of piston and rod 70, flexible flap 88 closes (solid lines) and the air in the closed end 56 of cylinder 54 is compressed and one way valve 90 opens to allow the pressurized air to flow into chamber 14. The air in the open end 60 of cylinder 54 is replenishing during the downstroke of piston and rod 70 by ambient air flowing through rod aperture 78 around the flutes 76 of rod 74. O-ring 84 seals between piston 72 and cylinder 54. In the case of an overpressure situation, where the pressure in chamber 14 is at a maximum safe pressure limit, as piston 72 compresses the air in cylinder 54 to that maximum safe pressure limit, relief valve 92 opens to bleed off the excess air to lower the pressure in cylinder 54 while one way valve 90 remains closed as not to increase the pressure in chamber 14.

Referring to FIG. 4, the dispensing handle 48 has a body 106 which houses a rear fuel delivery tube 108 which has an enlarged end 110 coupled to the output end 42 of flexible hose 38 and a second end 112 adjacent a fuel flow control valve 114. A front fuel delivery tube 116 has a first end 118 adjacent control valve 114 and a nipple end 120 extending out of handle body 106 connected to the flexible nozzle 52. Actuation lever 50 has a first end 122 wherein a pivot pin 124 pivotally engages actuation lever 50 in aperture 126, with pivot pin 124 being affixed to handle body 106. The elongated horizontal portion 128 of actuation handle 50 is moved by the user to regulate fuel flow. An actuation lever shield bar 129 extends from handle body 106 and encircles actuation lever 50 to help prevent inadvertent actuation thereof. Skirt 53 divergently extends from handle body 106 about the enlarged end 110 of rear fuel delivery tube 108 and in which bellows 46 may be stored during periods of non-use.

Referring to FIG. 5, the details of valve 114 are shown. Valve 114 consists of a sliding orifice plate 132 having a metering orifice 134. Orifice plate 132 is slideably engaged between front end wall 136 and rear end wall 138, both of which are affixed to handle body 106. Front end wall 136 has an aperture 140 into which is affixed a necked down portion 142 of first end 118 of front fuel delivery tube 116. Necked down portion 142 has an orifice 144. Rear end wall 138 has an aperture 146 into which is affixed a necked down portion 148 of second end 112 of rear fuel delivery tube 108. Necked down portion 148 has an orifice 150. Orifices 134, 144, and 150 cooperate to control the fuel flow rate and velocity by increasing or decreasing the effective flow area through which fuel may flow. As orifice plate 132 moves to a topmost position (as shown in FIG. 5) a maximum orifice flow area is exposed. When orifice plate 132 moves downward, it closes off the metering orifice 134. In this position (closed) it serves as a chamber creating means and forms, on each side of said plate, two spaced-apart chambers, each having its own adjacent fuel delivery orifice. While metering orifice 134 is shown as larger than orifices 144 and 150, this is not necessary and a combination of orifice sizes may be used to customize the flow characteristics. The fuel flow can be stopped by lowering orifice plate 132 such that none of metering orifice 134 is exposed to orifices 144 and 150 (as shown in FIG. 6). The fuel flow rate can be infinitely varied between no flow and full flow. Sealing is maintained between orifice plate 132 and necked down portions 142 and 148 through the use of close tolerances and standard lubricants not subject to degradation by fuel. Orifice plate 132 is biased toward the closed position by a spring 152. The position of orifice plate 132 is controlled by the user through pivotal movement of actuation lever 50 about pivot pin 124 disposed at the first end 122 of actuation lever 50. A flange 154 and perpendicular pin 156 extend from first end 122 toward orifice plate 132. Pin 156 terminates in a tapered portion 158 which contacts an end of orifice plate 132 which is biased that way by spring 152. Handle 50 is itself biased toward the closed valve position by a return spring 160 which is of longer length and of greater diameter than pin 156 and which is coaxially disposed upon pin 156. Front end wall 136 and rear end wall 138 have oppositely directed flanges 162 and 164, respectively, against which an end of return spring 160 abuts to bias handle 50 toward the valve closed position. A handle stop 166 is contacted by the first end 122 of actuation lever 50 to limit the travel of handle 50.

Referring to FIG. 6, the arrangement of handle body 106, handle 50, pivot pin 124, and tube 108 can be seen. Valve 114 is shown in the closed position with orifice plate 132 lowered and metering orifice 134 disposed out of alignment with orifice 150. The connection of rear end wall 138 to handle body 106 is clearly shown. Orifice plate 132 is guided and retained against lateral motion by edges 168 and 170 of rear end wall 138 which slightly overlap orifice plate 132 laterally of orifice plate 132 to act as a guide track. Return spring 160 is shown disposed about pin 156 and with ends bearing against flanges 154 and 164.

Actuation lever 50 and valve 114 operate together to finely incrementally control fuel flow by a combination of actuation lever 50 having a long throw with which the user can use their entire hand to operate, as opposed to just one finger or thumb, and an improved orifice type valve which allows incremental flow changes rather than the typical on-off plunger type valves. As this orifice type valve opens and closes, the hand pressure to hold handle 50 in a particular position will not change, unlike plunger type valves.

Overall, the portable fuel dispensing container provides a combination of features which prior art fuel dispensing containers did not. These include providing a fuel dispensing container in which the user can more easily and efficiently transport a quantity of fuel by utilizing a lightweight one-piece container and lightweight pump so that more fuel can be transported and more of that fuel can be used by providing an improved fuel siphoning and fuel well system. The fuel can be dispensed without moving the container due to the extending flexible hose and no extra unneeded hose is left hanging due to the extending and contracting properties of the flexible hose. The improved dispensing handle allows accurate control of fuel flow and the flexible nozzle directs that fuel into the container being filled. The pump handle locks in the retracted position during storage.

While the preferred embodiments have been fully described and depicted for the purposes of explaining the principles of the present invention, it will be appreciated by those skilled in the art that modifications and changes may be made thereto without departing from the spirit and scope of the invention set forth in the appended claims.

What is claimed is:

1. A portable fuel dispensing container comprising:

a) a pressurized container defining a chamber containing air and fuel;

b) a pressurizing means extending into said chamber; and c) a dispensing means extending from within the chamber which includes;

1) a pickup end for the removal of fuel from the chamber;

2) a flexible hose segment which is extendible to a length needed for fuel transfer, said hose segment including a plurality of flexible bellows;

3) a dispensing end equipped with a handle body having a skirt in which to store said bellows and including flow control means for regulating the velocity and amount of fuel which is being dispensed, said flow control means comprising;

a) a fuel delivery means joined to said flexible hose for transmitting fuel;

b) a chamber creating means within said fuel delivery means for forming two spaced-apart chambers having adjacent fuel delivery orifices, the first chamber of which receives pressurized fuel and the second of which transmits the fuel which is to be dispensed;

c) adjustment means to adjust the fuel flow through said fuel delivery orifices; and (4) a cap for securing said hose to the pickup end and to the container.

2. The portable fuel dispensing container of claim 1, wherein said pressurized container includes a lower recessed area comprising a fuel well into which the pickup end extends to remove fuel.

3. The portable fuel dispensing container of claim 1, wherein said pressurizing means is a hand pump which includes a one-piece piston and rod.

4. The portable fuel dispensing container of claim 1, wherein said pressurizing means is a hand pump which includes a rotatably locking pump handle.

5. The portable fuel dispensing container of claim 1, wherein said pressurizing means is a hand pump which includes an overpressure relief valve.

6. The portable fuel dispensing container of claim 1, wherein said pickup end includes a filter to prevent contaminates from leaving said container chamber.

7. The portable fuel dispensing container of claim 1, wherein said chamber creating means is a slidingly disposed plate, said plate having an orifice which can be selectively positioned between said fuel delivery orifices to regulate fuel flow.

8. The portable fuel dispensing container of claim 7, wherein said adjustment means is an elongated actuation lever which allows a user to selectively position said orifice plate to adjust fuel flow.

* * * * *